United States Patent [19]

Hauser

[11] Patent Number: 4,483,665

[45] Date of Patent: Nov. 20, 1984

[54] BELLOWS-TYPE PUMP AND METERING SYSTEM

[75] Inventor: Hugo Hauser, Palo Alto, Calif.

[73] Assignee: Tritec Industries, Inc., Sunnyvale, Calif.

[21] Appl. No.: 340,644

[22] Filed: Jan. 19, 1982

[51] Int. Cl.[3] ..... F04B 43/10

[52] U.S. Cl. ..... 417/401; 417/472

[58] Field of Search ..... 417/472, 473, 394, 401; 92/36, 40; 137/493.6, 512.2

[56] References Cited

U.S. PATENT DOCUMENTS

| | | | |
|---|---|---|---|
| 1,933,454 | 10/1933 | Sidney | 137/493.6 X |
| 2,212,667 | 8/1940 | Mayer | 417/394 |
| 2,464,095 | 3/1949 | Nies | 417/394 X |
| 2,489,783 | 11/1949 | Johnson | 137/493.6 X |
| 2,896,542 | 7/1959 | Forghieri | 417/401 |
| 2,951,450 | 9/1960 | Fisher | 417/473 X |
| 3,131,411 | 5/1964 | Mandy | 92/40 X |
| 3,194,169 | 7/1965 | Browne | 417/394 |
| 3,492,946 | 2/1970 | Martin | 92/36 X |
| 3,524,714 | 8/1970 | Grove et al. | 417/394 X |
| 3,749,526 | 7/1973 | Ferrentino | 417/394 X |
| 4,139,333 | 2/1979 | Sipos | 417/472 X |

*Primary Examiner*—Leonard E. Smith

*Attorney, Agent, or Firm*—Thomas E. Schatzel

[57] ABSTRACT

A system for the metered pumping and dispensing of fluid includes a filter for the pumped fluid and a pump connected to the filter. The pump is of the displacement type which includes a tubular, longitudinally-contractable bellows to receive fluid for pumping, fluid-activated reciprocating means to expand and contract the bellows, and means to selectively introduce working fluid to the reciprocating means. A rigid fluid-tight chamber is formed to surround the bellows, and means are provided to selectively introduce working fluid into chamber, whereby the working fluid assists in contracting the bellows as well as in partially balancing the internal pressure on the bellows.

5 Claims, 4 Drawing Figures

BELLOWS-TYPE PUMP AND METERING SYSTEM

BACKGROUND OF THE INVENTION

1. Field of the Invention

The present invention relates to a pump of the positive-displacement type and, more particularly, to an improvement in such a pump which utilizes a longitudinally-contractable bellows as the displacement means to pump relatively viscous fluids.

2. Description of the Prior Art

Positive displacement pumps utilizing bellows are well known. In such pumps, the fluid to be pumped enters a hollow tubular bellows through a one-way check valve. Usually, the discharge end of the bellows is constrained from movement, while the other end is connected to a reciprocating means which selectively works the bellows for longitudinal expansion and contraction. When contracted, fluid is expelled from the bellows under pressure, which is to say, pumped. It is a well known characteristic of such pumps that, at high pumping pressures, considerable internal pressure is exerted on the bellows which, together with flexing during expansion and contraction, often results in fatigue and early rupture of the bellows.

One application of bellows-type displacement pumps is the metered pumping of fluids. Bellows pumps are well suited for such usage because, each time the bellows is filled and then compressed, a relatively equal quantity of pumped fluid is discharged. Such a consistent metering capability is highly desirable in situations where the objective is to consistently dispense relatively precise quantities of fluid. An example of one such dispensing application is in the semi-conductor industry where the pumped fluid may be highly viscous photoresist which is applied to silicon wafers during the manufacture of integrated circuits. In such metering applications it can be appreciated that, after dispensing, drips of the pumped fluid are to be avoided. To alleviate dripping, auxillary devices known as "drawbacks" have been utilized. Typically, such devices create a negative pressure in the discharge line immediately after the pump discharge stroke is completed, and this keeps residual droplets from being discharged from the metering system.

SUMMARY OF THE INVENTION

A primary object of the present invention is to provide enhanced reliability and capacity in a pump of the positive displacement type which employs a longitudinally-contractable bellows as the displacement means.

Another object of the present invention is to provide an improved system for the metered pumping and dispensing of fluid comprising a bellows-type pump, a filter means for the pumped fluid, and a draw-back mechanism to prevent unwanted discharge (e.g., dripping) upon dispensing of the pumped fluid.

Still another object of the present invention is to provide an improved system for the pumping and dispensing of fluids, especially relatively viscous ones, comprising a bellows-type pump, a filter means for the pumped fluid, and a special check valve disposed in the fluid-flow conduit connecting the pump and the filter means to permit limited flow-back of the pumped fluid from the filter to the pump.

In accordance with the present invention, there is generally provided a positive-displacement pump of the type which includes a longitudinally contractable tubular bellows to receive fluid for pumping, fluid-activated reciprocating means to expand and contract the bellows, means to selectively introduce working fluid to the reciprocating means to actuate the same, and means to cooperatively utilize working fluid to assist the reciprocating means in compressing the bellows. More particularly, the pump of the present invention includes a rigid, fluid-tight chamber which surrounds the bellows, and means to selectively introduce working fluid into said chamber and to exhaust working fluid therefrom, whereby the working fluid assists in contracting the bellows as well as partially balancing the internal pressure on the bellows exerted by the pumped fluid.

The pump of the present invention is particularly well adapted to operate in a system for the metered pumping and dispensing of liquid where the system includes a drawback mechanism operated concurrently with, and by the same supply of pressurized working fluid, as the pump. Further, the improved system preferably includes a filter and a special check valve to relieve back pressure caused by the filter.

These and other objects and advantages of the present invention will become obvious to those of ordinary skill in the art after having read the following detailed description of the preferred embodiment as illustrated in the various appended drawings.

IN THE DRAWING

DETAILED DESCRIPTION OF THE PREFERRED EMBODIMENT

Figure 1:
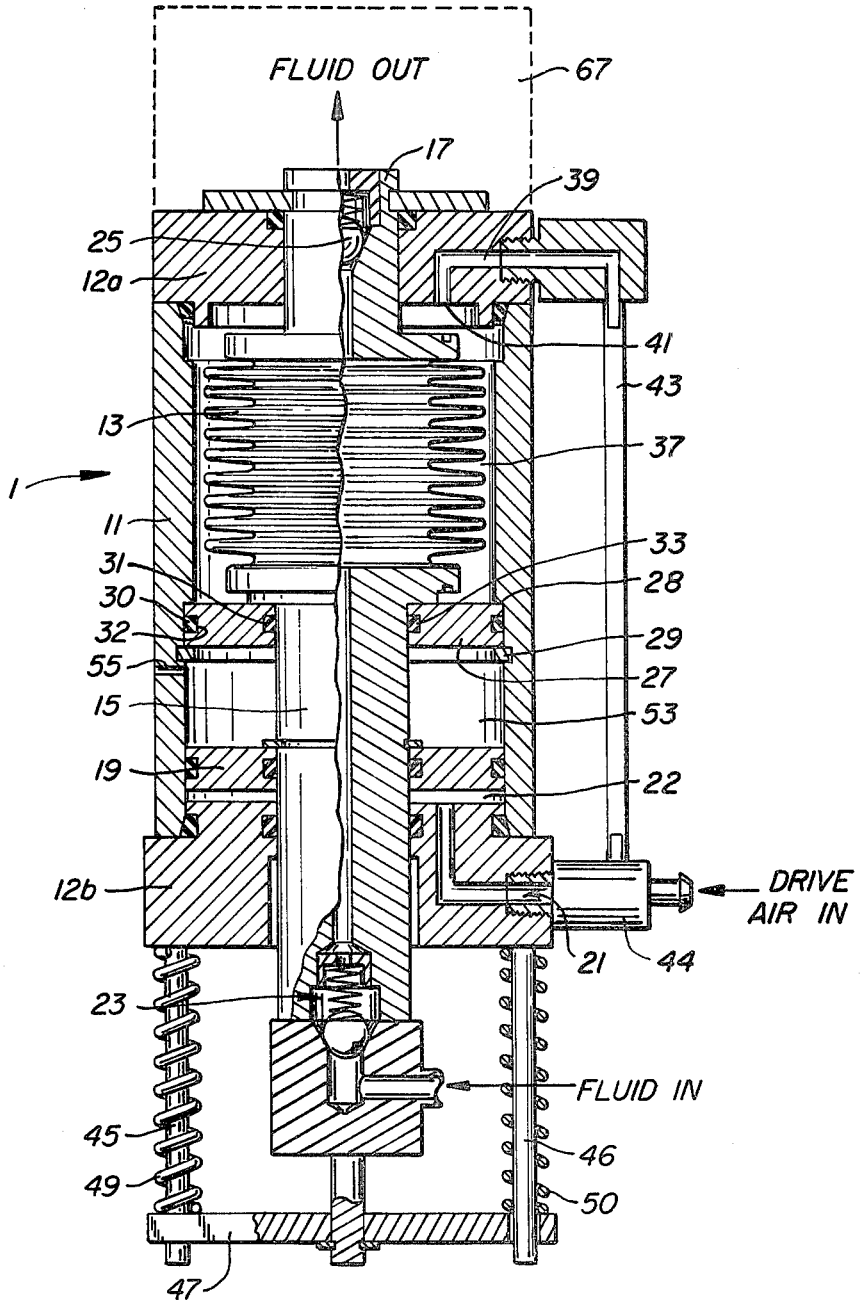
FIG. 1 is generally a longitudinal section of a pump according to the present invention, portions of which are shown cut away for facility of understanding.

Generally speaking, the pump 1 in FIG. 1 includes a stationary hollow cylindrical housing 11 circular in cross-section, annular end members 12*a* and 12*b* sealingly fixed across the opposed ends of the housing 11, a tubular bellows 13 mounted for contractive-expansive movement within the housing 11 along its axial centerline, a tubular inlet member 15 which is sealingly fixed to one end of the bellows 13 and which is slidable through the aperture in the end member 12*b* to carry pumped fluid into the bellows, an outlet fitting 17 which fixedly and stationarily extends through the aperture in the annular end member 12*a* and which is sealingly connected to the opposite end of the bellows 13 to carry pumped fluid therefrom, an annular disk-like piston 19 which is fixed at its inner periphery to the inlet member and which effects a sliding seal at its outer periphery against the interior wall of the housing 11, and a port means 21 to introduce working fluid into the chamber 22 defined between the disk-like piston 21 and the end member 12*b*. A one-way check valve 23 is mounted in flow communication to the inlet member 15 to control the direction of fluid flow therethrough. Likewise, a one-way check valve 25 is mounted to the outlet member 17 for directional control of fluid flow. (The direction of flow of the pumped fluid is indicated by the arrows in FIG. 1.)

As described in the broad terms above, the illustrated pump is conventional. Its operation can understand by first appreciating that FIG. 1 shows the bellows 13 to have been extended lengthwise, at which time fluid entered the bellows via the tubular inlet 15 and the one-way check valve 23. Action of the pump 1 is then initiated by selective introduction of a working fluid, usually compressed air, into the chamber 22; this causes reciprocation of the disk-like piston 19 which, in turn, drives the inlet member 15 to force longitudinal contraction of the bellows 13. As the bellows is compressed, pumped fluid is displaced from the bellows and expelled through the outlet fitting 17 via the one-way check valve 25. (Selective introduction of the working fluid is controlled by a conventional pneumatic control system, not shown.)

To expand the bellows 13 and concurrently retract the piston 19, various means can be provided. FIG. 1, by way of example, shows a particularly simple and effective retraction mechanism comprising a pair of post members 45 and 46 fixedly extending from the end member 12*b* in a direction parallel to the longitudinal axis of the housing 11, a cross-link 47 which extends between the post members for sliding movement thereon and which is retained near its midpoint on the reciprocatably-moveable tubular inlet 15, and a pair of helical springs 49 and 50 mounted around each of the post members to bias the cross link 47 from the end member 12*b*. In the operation of the illustrated retraction mechanism, springs 49 and 50 force retraction of the piston 19 and consequent expansion of the bellows 13 at such times as the pressurized working fluid is not exerting pressure against the piston 19. It should be evident, however, that alternative means can be provided to retract the piston and, hence, to expand the bellows. For example, the piston 19 could be of the double-acting type and associated control valving could be provided so that the working fluid would serve to selectively move the piston in either direction of reciprocation. Nevertheless, the illustrated embodiment is preferred because the primary forces exerted by the springs 49 and 50 act directly against the end member 12*b* and the piston 19; in other words, the spring forces are only indirectly transmitted to the bellows, thereby saving the bellows from fatigue.

At this juncture, it may be appreciated that the critical wear component of the pump is the bellows and, further, that fatigue of the bellows is caused by internal fluid pressure (i.e., the pumped fluid) as well as by flexing of the bellows in longitudinal expansion and contraction.

It is, as previously stated, a purpose of the present invention to provide improved reliability and capacity in a bellows-type pump. To this end, the pump of FIG. 1 includes an intermediate annular member 27 fixed within the housing 11. In the illustrative embodiment, the interior wall of the housing is formed with a circular step 28 against which the annular member 27 seats, and with a peripheral slot 26 to receive a conventional C-ring 29 which retains the annular member 27 in position. A fluid-tight seal between the annular member 27 and the interior wall of the housing 11 is conveniently accomplished, as shown, by providing an O-ring 30 located in a circular slot 32 formed in the outer periphery of the annular member. To provide a seal in sliding engagement with the outside wall of the tubular inlet member 15, another O-ring 31 is fitted in a circular slot 33 formed in the inner periphery of the annular member 27. Thus the annular member 27, together with the afore-described end member 12*a*, provides a sealed chamber 37 within the housing 11 surrounding the bellows 13.

It should be observed that the intermediate annular member 27 also defines, in conjunction with the piston 19, a chamber 53. This chamber would be fluid-tight but for a venting port 55 which is formed through the wall of the housing 11. The function of the port 55 is to let air freely enter and escape from the chamber 53, so that the action of the piston 19 is not affected by the pressures which would exist were the chamber 53 sealed.

In accordance with the present invention, a fluid-flow communication means 39 is provided to introduce working fluid into the chamber 37 surrounding the bellows 13. The illustrated communication means, by way of example, includes a passageway 41 formed through the end member 12*a* and a conduit 43 connected at its one end in communication with the passageway 41 for carrying working fluid to chamber 37. Preferably, the other end of the conduit 43 is connected to a fitting 44 in communication with the port means 21, so that working fluid is concurrently carried into the piston chamber 22 as well as into the bellows chamber 37. Thus the working fluid serves two purposes. First, the working fluid exerts pressure to displace the annular piston 19 within the chamber 22; this in turn, compresses the bellows 13 longitudinally. Second, the working fluid surrounds and supports the bellows.

The benefits of the above-described features of the present invention (especially, selective introduction of pressurized working fluid into the chamber 37 surrounding the bellows 13) have been proven in extended testing. In particular, the subject features significantly extend the life of the bellows 13 and, therefore, increase the durability of the pump. Another important result of the introduction of working fluid into the chamber surrounding the bellows is to enable the pump to be operated at significantly higher pressures. To appreciate this, one must keep in mind that the capacity of a bellows-type pump, in terms of pumping pressure, is ordinarily limited by the ability of the bellows to withstand internal pressures without bursting or rupturing. In accordance with the present invention, the bellows 13 is subjected to external as well as internal pressure. In effect, the external pressure of the working fluid acts to balance an equal internal pressure of the pumped fluid and therefore, the net pressure differential across the bellows is substantially reduced. Furthermore, as the bellows is compressed (with a consequent reduction in its external surface area) the pressure of the working fluid within the chamber 37 serves to cause further contraction. Thus, the net effect of the pressurized working fluid within chamber 37 is to augment and increase the forces which contract the bellows.

In practice, about one-third of the force utilized to compress the bellows is exerted by the pressurized fluid internal of the chamber 37 surrounding the bellows; and about two-thirds of the force tending to contract the bellows is exerted by the piston 19. The relative magnitudes of these two forces is, of course, a matter of choice, being determined merely by geometrical design. Further in practice, the illustrated pump has proven surprisingly effective in pumping viscous fluid such as photoresists, which have viscosities sometimes well exceeding 2000 centistokes. In part, the success is due to the increased pumping pressure obtainable with the illustrated pump; for example, discharge pressures of 200 psi or more can be maintained without adverse effect upon the life of the bellows. It should be appreciated that the high-pressure capabilities of the pump of the present invention permit it to be successfully utilized with a filtering mechanism as will be described below in conjunction with FIG. 2.

Also in practice, especially when dispensing photoresist, the pump and bellows are formed of stainless steel. The valves, diaphragms, and similar mechanisms are usually formed of Teflon or similar self-lubricating materials.

Figure 2:
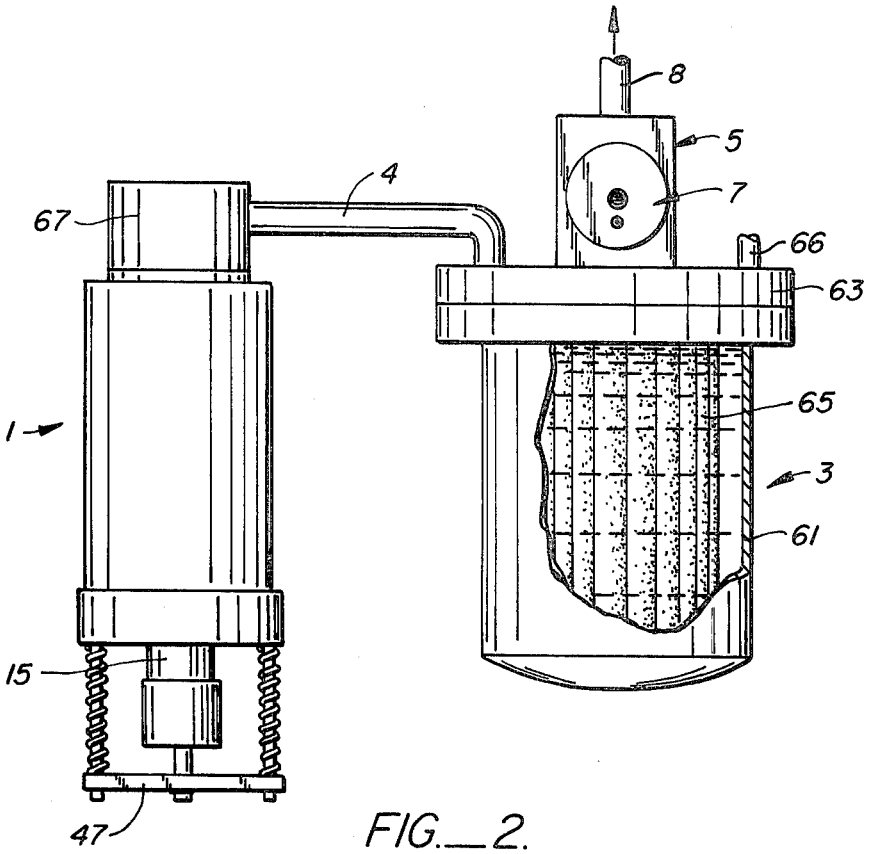
FIG. 2 is a schematic view of a system for metered pumping, filtering, and dispensing of fluids incorporating the pump of FIG. 1, with portions of elements of the system shown cutaway and schematically views for purposes of clarity.

The system in FIG. 2 generally comprises the aforedescribed pump 1, a filter means 3 connected to the pump via a conduit 4 to receive and filter the pumped fluid, and a drawback mechanism 7 connected to a discharge fitting 5 on the filter 3 to prevent dripping or other unwanted discharge of the dispensed fluid through a pumped fluid dispensing conduit 8. (In practice, a conventional one-way check valve, not shown, is mounted in the discharge fitting 5 in location preceding the drawback mechanism 7 to prevent back flow into the filter when the drawback mechanism is actuated, as will be described hereinafter.) Preferably, the filter 3 is a commercially available mechanism comprised of a stationary housing 63 to which a bowl 61 is sealingly affixed to receive pumped fluid. A filter element 65, preferably of the cylindrical cartridge type, is sealingly mounted to the housing 63 so that all fluid which passes from the bowl 61 to discharge from the housing must first pass through the filter element. The filter mechanism 3 also typically includes a vent means 66 to relieve air from the bowl 61, especially when operation of the system is initiated. It should also be understood that the pump 1 includes an exit fitting 67 which, preferably, contains a special one-way check valve which will be described hereinafter in conjunction with FIG. 4.

Figure 3:
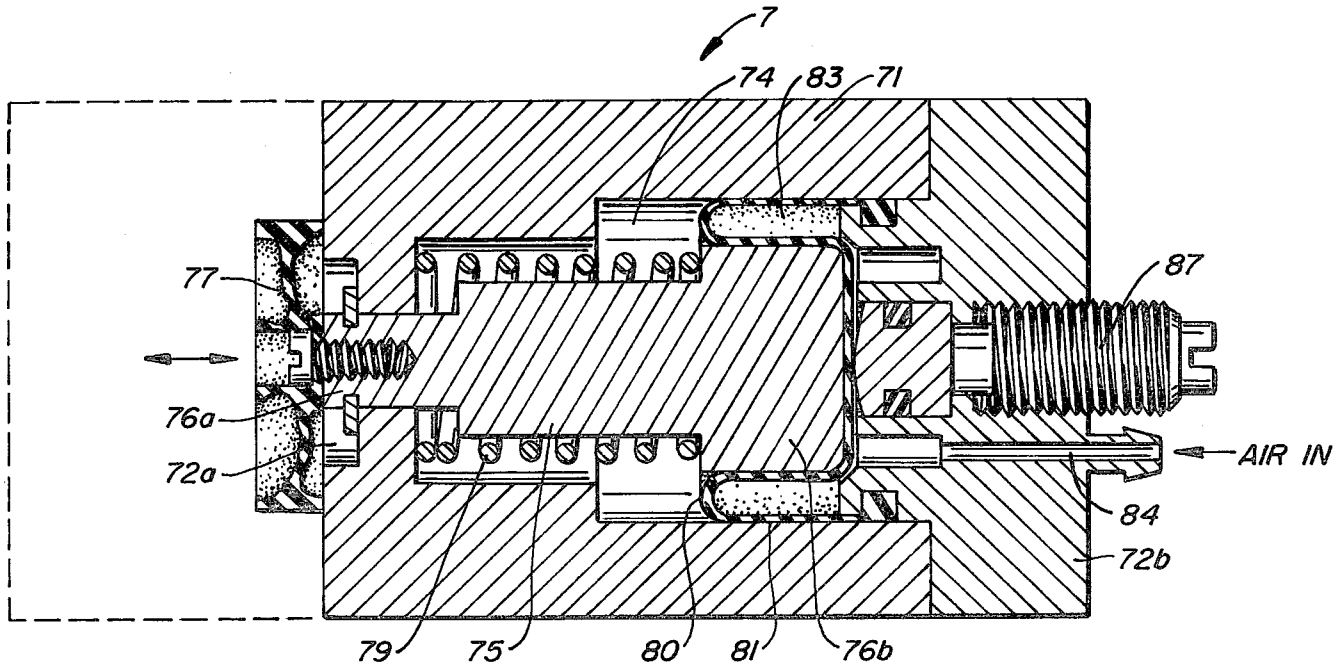
FIG. 3 is a sectional view of a drawback mechanism for use in the system of FIG. 2.

Referring now to FIG. 3, the drawback mechanism 7 generally includes a housing 71 fixed to the discharge fitting 5 from the filter 3. More particularly, the housing 71 has a hollow interior 74, a closed end 72*b*, and an open end 72*a* which is mounted in registry with an aperture (not shown) in communication with the interior of the pumped fluid dispensing conduit 8 connected to the discharge fitting 5. Mounted within the interior 74 of the housing is a reciprocatable mandrel 75 whose distal end 76*a* projects into the opening at the end 72*a* of the housing 71 and whose worked end 76*b* resides within the interior 74 of the housing. Sealingly fixed across the open end 72*a* of the housing 71 is a non-foraminous, flexible diaphram 77 which is also attached, near its center, to the distal end of the mandrel 75. In the illustrated mechanism, a helical compression spring 79 is mounted around the mandrel 75; one end of the spring 79 abutts the end wall 72*a* of the housing 71, and the other end seats against a step 80 forward on the mandrel 75. (The function and effect of the compression spring 79 is to bias the mandrel such that its normal position, as shown, is one of being retracted within the housing.) A second flexible diaphram 81 is sealingly fixed across the interior 74 of the housing 71 and is attached to the worked end 76*b* of the mandrel 75. This second diaphram defines, with the closed end 72*b* of the housing, a plenum chamber 83. A port 84 is formed through the housing in communication with the interior of the chamber 83, and conduit means (not shown) is connected to the port 84 to carry pressurized working fluid into the chamber 83. (Preferably, the conduit means also is in fluid-flow communication with the line which carries working fluid to the pump 1 of FIG. 1.) The draw-back mechanism further includes, in its preferred embodiment, an adjustment means 87 to selectively adjust the position of the mandrel 75.

The operation of the drawback mechanism of FIG. 3 can now be readily understood. First, it should be appreciated that FIG. 3 shows the position of the mandrel 75 at the completion of its "suction stroke". The mandrel remains in this position until the pumping stroke of the pump 1 begins. Concurrent with the pumping stroke, pressurized working fluid is introduced, via the port 84, into the plenum chamber 83 behind the diaphragm 81 of the draw-back mechanism. This causes the chamber 83 to expand, as the pressure of the working fluid on the diaphram 81 forces the mandrel 75 to move towards the open end 72*a* of the housing. As the mandrel moves, the first diaphragm 77 is pressed into the fluid-flow channel of the pumped fluid dispensing conduit 8. The result of protrusion of the diaphram 77 is to displace or expel pumped fluid to discharge.

After the power stroke of the pump 1 is completed, the pressurized working fluid is vented from the plenum chamber 83, thereby relieving pressure on the diaphram 81. While venting proceeds, the spring 79 forces the mandrel 75 towards the closed end 72*b* of the housing, and consequently, the diaphram 77 is drawn back from protrusion into the pumped fluid dispensing conduit 8. As the diaphram draws back, a suction is created in the discharge channel to prevent droplets of pumped fluid from being unintentionally dispensed following the power stroke of the pump 1. (More exactly, the suction usually draws back a meniscus which forms at the outlet of the discharge channel.)

Finally, with regard to the drawback mechanism, it may be noted that operation of the drawback mechanism with the same pressurized air as operates the pump has certain advantages, to wit, commonality of the air supply "cushions" or somewhat slows the ejection stroke of the drawback mechanism, thereby preventing the drawback from "spitting" the pumped fluid from the dispensing conduit 8.

Figure 4:
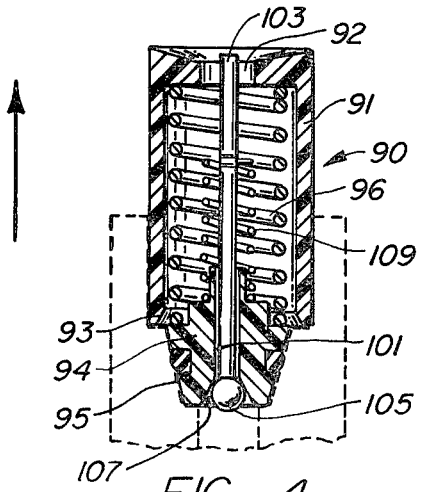
FIG. 4 is a sectional view of a check valve for use in the system of FIG. 2, enlarged for purposes of clarity.

FIG. 4 shows a special valve 90 particularly adapted for use with the pumping-filtering system of FIG. 2. The primary function of valve 90 is to act as a one-way check valve for pumped fluid; the auxilliary function of the valve 90 can best be understood by considering the operation of the filter 3 of FIG. 2. To wit, during the power stroke of the pump 1, the pumped fluid exerts compressive pressure upon the filter element 65. Then, upon completion of the power stroke when the compressive pressure is released, the mechanical elasticity of the filter element 65 causes it to expand to its original configuration. Expansion of the filter element, in turn, creates a back pressure which tends to force pumped fluid in the bowl 61 back toward the pump 1. To relieve the back-pressure, hence to improve the metered dispensing capabilities of the system, the special valve of FIG. 4 is provided to permit limited flow-back of the pumped fluid. (Without the special valve of FIG. 4, the pressures exerted by the mechanical properties of the filter element 65 can cause fluid leakage past the check valve immediately preceding the drawback mechanism.)

The valve of FIG. 4 includes a body 91 of generally cylindrical configuration having an open interior, preferably circular in cross-section. The body 91 is stationarily mounted at a suitable location in the exit fitting 67 from the pump 1 (FIG. 2), so that all pumped fluid passes through the valve. (The direction of primary flow is indicated by the arrow in FIG. 4). The discharge end of the valve body 91 is closed but for a central aperture 92 formed therein. The other end of the body 91 has formed therein a slightly larger opening 93 to receive an inverted frustro-conical flow stoppage member 94. The exit fitting 67 includes a tapered seat 95 to receive the frustro-conical stoppage member 94. A first helical compression spring 96 is mounted within the body 91 to normally bias the stoppage member 94 against its seat 95.

In the above general terms, the special valve 90 functions as a conventional one-way cleck valve. To wit, during the pumping stroke of the pump 1, the primary flow of the pumped fluid is in the direction indicated. The pressure of the primary flow on the smaller end of the frustro-conical stoppage member 94 causes the member to rise from its seat 95 and, concurrently, to compress the spring 96. Fluid then flows through the space between the frustro-conical member and the seat, enters the interior of the valve body 91, and then flows through the aperture 92 into the line 4 which carries pumped fluid to the filter 3 (FIG. 2). In the absence of pump pressure, the frustro-conical stoppage member 94 functions to block any flow in a direction opposite to the primary flow. That is, the spring 96 operates to force the frustro-conical member 94 securely and sealingly into its seat 95, thereby closing the flow passage.

As mentioned above, the valve 90 mechanism performs the auxilliary function of permitting limited flow in the reverse direction (i.e., opposite to the arrow) under fluid pressure caused by expansion of the filter element 65. The structure which accomplishes this function includes a linear channel 101 formed along the axial center line of the frustro-conical stoppage member 94 and a stem member 103 slidably located in the channel. In the preferred embodiment, a ball-shaped piece 105 is formed at the end of the stem member and a V-shaped seat 107 is formed in the smaller end of the frustro-conical member to receive the ball. The other end of the stem member extends into the interior of the body 91. A second helical compression spring 109 is mounted to surround the stem, with one end of the spring being fixed to the stem and the other end pressed against the frustro-conical member 94.

The auxilliary function of the valve 90 of FIG. 4 can now be understood, especially by considering conditions after completion of the pumping stroke of the pump 1, when expansion of the filter element 65 creates a reverse pressure of fluid in the conduit 4. When this occurs, pressure of the fluid on the free end of the stem member 103 forces the stem to slide within the channel 101 against the force of the helical spring 109 and, thereby, to create a space between the ball 105 and its V-shaped seat 107 through which liquid can pass. The reverse flow of liquid then allows the filter element 65 to expand. Once the expansion is completed (so that the back pressure is alleviated), the spring 109 forces retraction of the stem member 103 and re-seating of the ball 105 in its V-shaped seat 107. (It should be noted that the ball member remains firmly seated in a flow-blocking position when liquid flow is in the primary direction.) In practice, tension of the spring 109 is usually chosen so as to maintain about one psi back pressure in the line 4.

Finally, it should be noted that the preferred embodiment of the special valve 90 has been described, but that alternative embodiments could be employed. For example, the first spring 96 could be eliminated and the second spring 109 extended so that, while still being affixed to the stem member 103, one end of the spring 109 seats against the valve body 91 while the opposite end presses against the frustro-conical stoppage member 95. In this alternative embodiment, the function and operation of the valve 90 would remain the same, with the only structural differences being elimination of the spring 96 and modification of the spring 109 on the stem member 103.

I claim:

1. A system for the metered pumping and dispensing of fluid comprising a filter means for filtering pumped fluid, a pump connected to said filter means to pump fluid thereinto, said pump comprising a positive displacement pump of the type which includes a tubular, longitudinally-contractable bellows to receive fluid for pumping; fluid-activated reciprocating means to expand and contract the bellows; means to selectively introduce working fluid to the reciprocating means to actuate the same; a rigid fluid-tight chamber formed to surround the bellows; and means to selectively introduce working fluid into said chamber and to exhaust working fluid therefrom;

a discharge means connected to receive filtered fluid from said filter means; and a drawback mechanism mounted in communication with said discharge means to prevent dripping of pumped fluid from the outlet of said discharge means, the drawback mechanism comprising a mechanism housing with an aperture leading to an internal cavity within the housing, a first and second chamber formed within said cavity, a first flexible diaphragm sealingly affixed within the housing so as to create a fluid tight boundary between the first and second chamber, a reciprocable member slidingly mounted within the first chamber and in abutment with the first diaphragm, biasing means for holding the reciprocable member in abutment with the first diaphragm, a passage in the housing connecting the second chamber with a source of pressurized working fluid, and a second flexible diaphragm sealingly affixed over said aperture which opens into the first chamber and connected to a distal end of the reciprocable member.

2. A system according to claim 1 further including a valve mechanism interposed between said filter means and said pump to permit limited flow-back of the pumped liquid from said filter means.

3. A system according to claim 2 wherein said valve mechanism comprises a one-way check valve inclusive of a frustro-conical stoppage member, a linear channel formed along the axial centerline of said frustro-conical member to provide a flow passage, a stem member slidably located in said channel, blocking means formed at one end of said stem member to block flow through said channel during the pumping stroke of said pump, and spring means normally biasing said stem member in a flow-blocking position while permitting back pressure from said filter means to move said member to permit fluid flow past said blocking means.

4. A system according to claim 2 including conduit means to carry pressurized working fluid to said drawback mechanism to activate the same concurrently with said fluid activated reciprocating means, the conduit means being connected to said passage in the mechanism housing.

5. A system according to claim 2 wherein the working fluid is compressed air.

* * * * *